United States Patent [19]

Wittmann

[11] 4,359,235

[45] Nov. 16, 1982

[54] SKI BRAKE

[75] Inventor: Heinz Wittmann, Vienna, Austria

[73] Assignee: TMC Corporation, Baar, Switzerland

[21] Appl. No.: 211,868

[22] Filed: Dec. 1, 1980

[30] Foreign Application Priority Data

Nov. 30, 1979 [AT] Austria ..... 7622/79

[51] Int. Cl.[3] ..... A63C 7/10

[52] U.S. Cl. ..... 280/605; 188/6

[58] Field of Search ..... 280/604, 605; 188/5, 188/6

[56] References Cited

U.S. PATENT DOCUMENTS 4,087,113 5/1978 Riedel ..... 280/605

4,266,803 5/1981 Himmetsberger ..... 280/605

FOREIGN PATENT DOCUMENTS 2920517 1/1980 Fed. Rep. of Germany ..... 280/605

*Primary Examiner*—Robert J. Spar

*Assistant Examiner*—Donald W. Underwood

*Attorney, Agent, or Firm*—Flynn, Thiel, Boutell & Tanis

[57] ABSTRACT

A ski brake having a ski mountable base plate and having a pair of braking arms, each braking arm having a disk-shaped head at one end and being supported intermediate its ends on the base plate for limited pivotal and axial movement about an axis normal to the arm and transverse of the ski. A bearing bar is pivotally supported in the base plate about the axis, and a pedal is pivotally supported on the bearing bar at a location remote from the axis. A receiving recess is provided in each lateral side of the pedal and defines a guide surface which forms an acute angle with the ski surface when the ski brake is fully retracted. Each disk-shaped head is supported for pivotal movement about its axis on a respective guide surface with a side thereof disposed against and parallel to the guide surface. The undersurface of the pedal includes a flattened surface extending forwardly from beneath the pivot axis and upwardly at an acute angle to the rest of the undersurface. The pivotal movement of the pedal on the bearing bar as the ski brake is pivoted to a retracted position acts on the disk-shaped heads through the guide surfaces to pull the braking arms laterally inwardly to a position above and parallel to the ski.

18 Claims, 15 Drawing Figures

SKI BRAKE

FIELD OF THE INVENTION

This invention relates to a ski brake and, more particularly, to a ski brake in which two braking mandrels project, in the braking position, next to the two ski edges below the running surface of the ski and are each the free end of a braking arm which is preferably formed of a spring wire.

BACKGROUND OF THE INVENTION

It is known to provide a ski brake of the foregoing type in which the swivel axes of the braking arms each extend transversely with respect to the ski inclined in relationship to same and are supported on guide surfaces which extend normal to the individual swivel axes, which braking arms can be swung against an erecting spring force by means of a force applied directly by a ski boot or indirectly by an interpositioned sole plate through force-transmitting means toward the upper side of the ski, from the braking position into a fully retracted position, in which position the two braking arms are held in a retracted position lying approximately parallel with respect to the upper side of the ski and at least partially above the same. In this conventional solution, the braking arms are each arranged on a base which is fixedly secured on the upper side of the ski, the guide surfaces of which base define acute angles with the upper side of the ski so that the individual swivel axes each extend transversely with respect to the ski and inclined with respect to the ski. A spring is arranged in the braking arm itself, which spring, corresponding to the different positions in the braking position or in the fully retracted position of the braking mechanism, is either loaded by a flattened control piece or is relaxed in the direction of the flattened area of the control piece. Further, each braking arm has a multiply bent control member, through which the associated braking arm can be swung by the ski boot into the fully retracted position and can be held there. In the fully retracted position, used for downhill skiing, each braking arm lies partly inwardly of the associated side surface of the ski. Part of the braking arm, however, projects beyond the associated side surface of the ski. This arrangement is caused by its design and does not totally satisfy the need to hold the braking arms in the fully retracted position of the braking mechanism totally inwardly of the two side surfaces of the ski. Thus a ski which is equipped with such a brake can get caught on obstacles on the slope, such as roots, rocks or the like. A further disadvantage of the known construction, as already mentioned, consists in each braking arm having a separate spring suspension which is arranged within the shaft of the arm. Through this, the dimensions of the individual braking arms are increased in the area in which they must carry out a swivelling movement relative to the two upper ski edges. Through this the angle area needed for a satisfactory operation is reduced. Because of this design, specially formed extensions for both braking arms must be provided, as a result of which the stability of the entire braking mechanism suffers.

In ski brakes it is already known to manufacture individual braking arms of a wire material or of a spring wire material with many bends which are designed as needed, wherein certain wire sections act as guide members, others in turn as braking mandrels.

The purpose of the invention is to improve a ski brake of the above-mentioned type so that in the fully retracted position of the braking mechanism each braking arm lies totally inwardly of the associated side surface of the ski and wherein the braking arms are manufactured of a wire or spring wire material.

SUMMARY OF THE INVENTION

The set purpose is attained inventively by constructing a guide surface for each braking arm in a receiving recess of the pedal, wherein each receiving recess is constructed in a frame of the pedal and in the fully retracted position of the braking mechanism is positioned at an acute angle with respect to the upper side of the ski, in which receiving recesses the individual braking arms are supported by means of their heads and are each pivotal about a swivel axis which is normal to the associated guide surface of the pedal, and by each of the braking arms having a nipple which is supported in a holding opening of the associated leg of the base plate and, in relationship to the longitudinal axis of the ski, can be transversely moved back and forth. Provided in alignment with the two holding openings in the two legs of the base plate are bearing openings in bearing plates of the base plate for receiving bearing pins of an approximately omega-shaped bearing bar, wherein a support part is provided on the area of the bearing bar which is remote from the two bearing pins, which support part is arranged with the adjacent sections of the bearing bar in a groove in the pedal, and by the pedal having on its end which is remote from the swivel axis of the braking mechanism a flattened surface which extends at an acute angle with respect to the undersurface of the pedal.

By the inventive measure, aside from a simple construction and arrangement of the two braking arms, a secure swinging of the same into the fully retracted position of the braking mechanism inwardly of the two side surfaces of the ski is assured.

Furthermore, through the aligned arrangement of the nipples of the individual braking arms on the one side and the two bearing pins of the bearing bar on the other side a sturdy arrangement of the pedal of the braking mechanism is achieved, wherein between the bearing bar and the pedal during the last stage of stepping down and, accordingly, in the first stage of the swinging up, there occurs an additional swivelling. This swivelling permits relative movement between the pedal and the individual braking arms, namely through the inventive development of the receiving recess, which recess serves as a guide surface for the head of the associated braking arm, which head sits in the recess. In this manner, the degree of the swinging in or out of the braking arms, within certain limits, can be selected.

Furthermore, it is important for the invention that the braking arms can be bent twice over their length, wherein the first bend, viewed in the fully retracted position of the braking mechanism, turns upwardly and the second bend is such that the braking wing which exists on said section of the braking arm extends again approximately parallel with respect to the longitudinal axis of the ski. It is assured by this measure that the section of the braking arm which carries the braking wing will lie, in the fully retracted position of the ski brake, above and simultaneously at least partly within the guide plate of the ski binding with which the ski brake is coupled.

An advantageous embodiment of the invention consists in the pedal being divided by a bend groove which extends substantially at a right angle with respect to the longitudinal axis of the ski, wherein the portion of the pedal which receives the bearing bar is constructed thick and the other portion thinly as a cover part, and by providing in the thick area of the pedal receiving recesses for the individual braking arms in their swung-in position and receiving points for two tension springs which, in the fully retracted position of the braking mechanism, are disposed in the individual receiving points. In this manner it is possible to adjust the height dimension of the ski brake under the ski shoe sole to be in the fully retracted position of the braking mechanism as low as possible.

In a further development of this aspect of the invention, the other end of each spring is connected to a spring-steel plate, which in turn is secured in the base plate. This embodiment also contributes to a low construction of the ski brake, because the spring-steel plate can be deformed elastically as a holding mechanism below the ski shoe sole. Such a steel plate has thereby the required thickness and elasticity while allowing a low brake height.

A further development of the invention lies in the base plate having in its area which receives the bearing bar a recess, which extends in the direction of the longitudinal axis of the ski and has an end with overload surfaces on both sides, each defining approximately a 45° angle with respect to the longitudinal axis of the ski. In this manner it is possible to easily select the slope of the two braking arms which is to be assumed in the braking position of the braking mechanism. Furthermore, since the bearing bar has a certain elasticity at a right angle with respect to the longitudinal axis of the ski, an additional swivelling can occur during an overload, wherein the two control legs of the bearing bar, which measure is also inventively important by itself, slide along the two overload surfaces.

A further thought of the invention lies in an approximately T-shaped holding part being secured to the underside of the pedal, which holding part has two spring openings which are aligned at a right angle with respect to the longitudinal axis of the ski, in each which opening one end of the respective tension spring is connected, and by the holding part having on its forward edge and on its two adjacent edges a holding wall in which the two spring openings are constructed. By the provision on both sides of the holding part of several openings in the holding wall which lie one behind the other in the direction of the longitudinal axis of the ski, a change of the initial tension of the springs for different braking actions or a reduction of the spring tension within certain limits can be carried out. A further advantage of this holding part lies in the pedal being able to be mounted easily on the support part of the bearing bar and, if needed, being able to be removed easily therefrom. Furthermore, the force which is needed for the swinging out of the braking arms can be changed.

A still further advantage of the invention lies in the head of each braking arm being constructed with a swivel pin which is supported in an opening in the receiving recess, extends through the opening and is maintained in the opening by a retaining nut, a rivet, a washer or the like on its free end.

Furthermore, it is an important development of the invention if the two nipples of the braking bar also extend through the bearing openings of the two bearing plates of the base plate and are supported for reciprocal movement in said bearing openings at a right angle with respect to the longitudinal axis of the ski, wherein preferably two additional bars are provided as legs of a U-shaped part of the braking bar and are supported on the individual nipples by means of bearing eyes. This embodiment obviates the need for a separate bearing bar. Also, the additional reinforcement by means of a U-shaped part is only needed, if the braking mechanism due to the thickness of the wire material of the braking bar would not be sufficiently strong.

BRIEF DESCRIPTION OF THE DRAWINGS

Further advantages, details and characteristics of the invention are described in greater detail hereinafter in connection with the associated drawings, in which.

Figure 1:
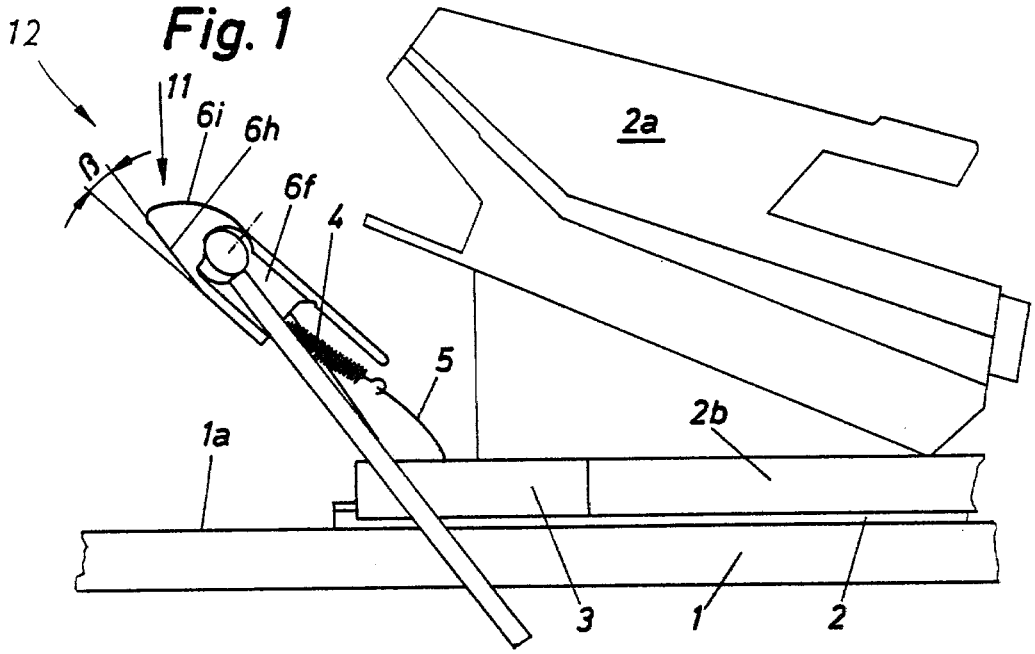
FIG. 1 is a side view of one embodiment of an inventive ski brake in the braking position.

Certain terminology will be used in the following description for convenience in reference only and will not be limiting. The words "up", "down", "clockwise" and "counterclockwise" will designate directions in the drawings to which reference is made. "Front" and "rear" will be used to refer to directions toward the tip and the tail of the ski, respectively. "In" and "out" will refer to directions toward and away from, respectively, the geometric center of the device and designated parts thereof. Such terminology will include the words specifically mentioned, derivatives thereof, and words of similar import.

DETAILED DESCRIPTION

Figure 2:
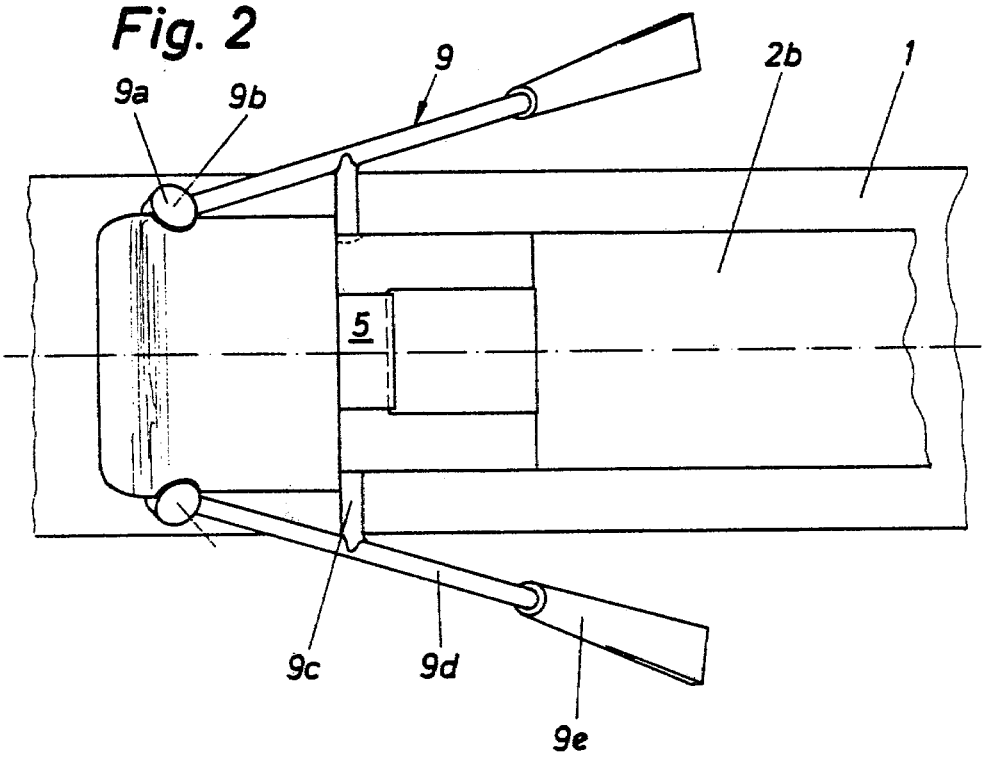
FIG. 2 is a top view of FIG. 1.
Figure 9:
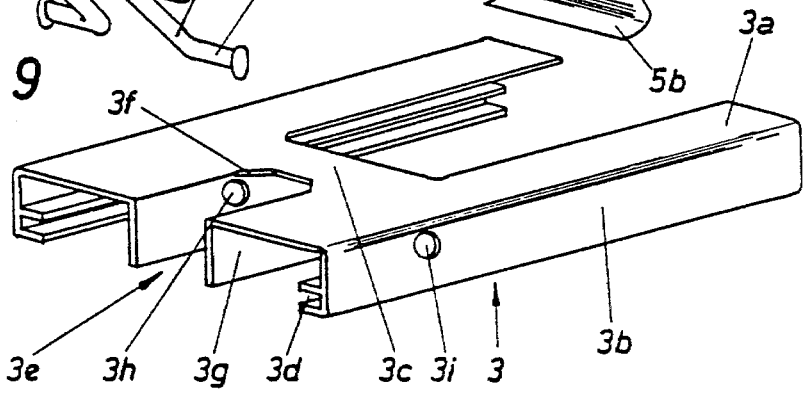
FIG. 9 is an oblique view of a base plate which is a component of the ski brake of FIG. 1.
Figure 14:
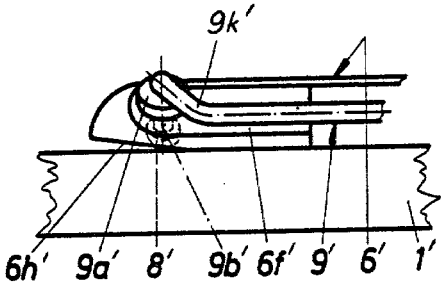
FIG. 14 illustrates the ski brake of FIG. 12 in a different position of operation.
Figure 15:
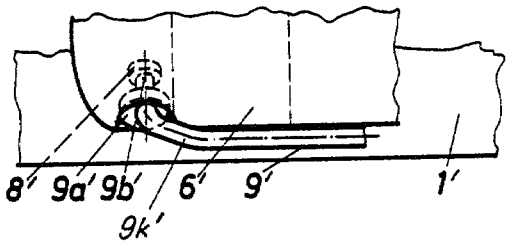
FIG. 15 is a top view of the ski brake illustrated in FIG. 13.
Figure 12:
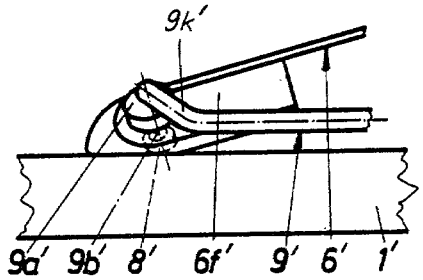
FIG. 12 is a side view of part of an alternative embodiment of a ski brake embodying the present invention.
Figure 13:
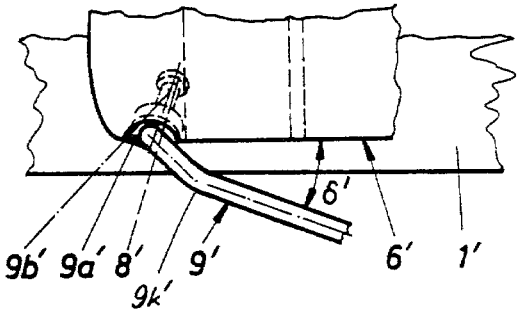
FIG. 13 is a top view of the ski brake of FIG. 12.

According to FIGS. 1 and 2, a guide rail 2 which is not important to the invention is secured by means of not illustrated screws on a ski 1. A ski binding **2*a* is adjustably and lockably received on the guide rail 2 in a conventional manner by means of a guide plate 2*b* for movement longitudinally of the ski 1, but cannot be moved upwardly away from the ski 1. Adjacent the guide plate 2*b* in the direction of the tip of the ski is a base plate 3. Details of the base plate 3 are illustrated in FIG. 9. The base plate 3 is hollow and is also adjustably received on the guide rail 2 and not movable upwardly away from the ski 1. The base plate 3 has, viewed from its upper side 3***a*, approximately a U-shape, wherein the two legs 3*b* of the U extend in the longitudinal direction of the guide rail 2 and wherein the connecting web 3*c* of the U is positioned at a right angle with respect to each of the legs 3*b*. The connecting web 3*c* of the base plate 3 thereby faces the tip of the ski 1. Both of the legs 3*b* and also the connecting web 3*c* of the U have their lateral edges bent downwardly toward the ski 1. A guide groove 3*d*, which is formed by two inwardly extending horizontal flanges, is provided on the inside of each of the lateral bent sections along the entire length of the base plate 3, with the help of which grooves the base plate 3 is slidably received on the guide rail 2 and supported thereon at a constant distance above the ski 1.

The connecting web 3*c* of the base plate 3 has a recess 3*e* which extends from the end of the base plate 3 closest to the tip of the ski toward the ski tail, parallel to and symmetric about the longitudinal axis of the ski 1. The two corners of the substantially rectangular recess 3*e* which are closest to the ski tail are angled at approximately 45° to the longitudinal axis of the ski 1 to form overload edges 3*f*, the function of which will be described in greater detail hereinafter. Bearing plates 3*g* end flush with the open end of recess 3*e*. The bearing plates 3*g* have a rectangular design and extend downwardly from the upper side 3*a* of the base plate 3 substantially vertically with respect to the upper side 1*a* of the ski 1 (FIG. 1) and parallel with respect to the longitudinal axis of the ski 1. The length of each bearing plate 3*g* is the same as the width of the connecting web 3*c* of the base plate 3, which width extends in the longitudinal direction of the ski 1.

Approximately below each overload edge 3*f*, each bearing plate 3*g* has a bearing opening 3*h*. A holding opening 3*i* is provided through each downwardly bent section of the legs 3*b* in coaxial alignment with the bearing openings 3*h*. The holding openings 3*i* and also the bearing openings 3*h* are vertically positioned so that they lie above the imaginary plane containing the two guide grooves 3*d*.

Figure 10:
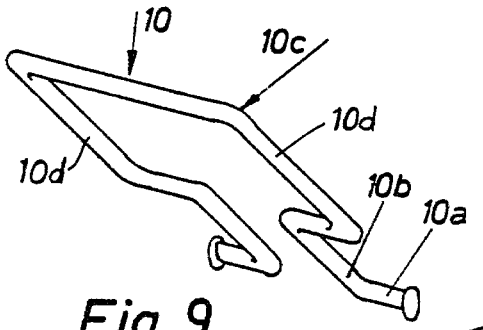
FIG. 10 is an oblique view of a bearing bar which is a component of the ski brake of FIG. 1.
Figure 11:
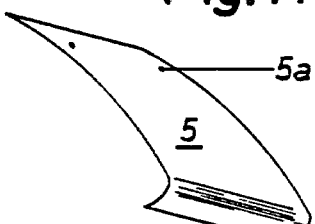
FIG. 11 is an oblique view of a bearing plate which is a component of the ski brake of FIG. 1.

A bearing bar 10 which is shown in FIG. 10 is supported in the two bearing openings 3*h* for limited pivotal movement by means of two bearing pins 10*a*. The bearing bar 10 has an omega-shape, and is preferably a single pice of metal rod, the individual sections of which are formed by bends in the rod. The individual bearing pins 10*a* are designed sufficiently long so that they project somewhat beyond the respective bearing plates 3*g* through which they extend. Control or bearing legs 10*b* are connected to the individual bearing pins 10*a* and project at a right angle thereto. The plane containing the two bearing ends 10*a* and control legs 10*b* is, in the braking position of the ski brake, positioned at an angle of 45° to 90°, preferably 55°, to the upper side 1*a* of the ski 1. The function of the two control legs 10*b* will be described in greater detail hereinafter. The two control legs 10*b* are connected by a support part 10*c* which has a substantially square design and supports a pedal 6 which will yet be described. The bearing bar 10 is open in the area which is provided between the two control legs 10*b*.

Figure 7:
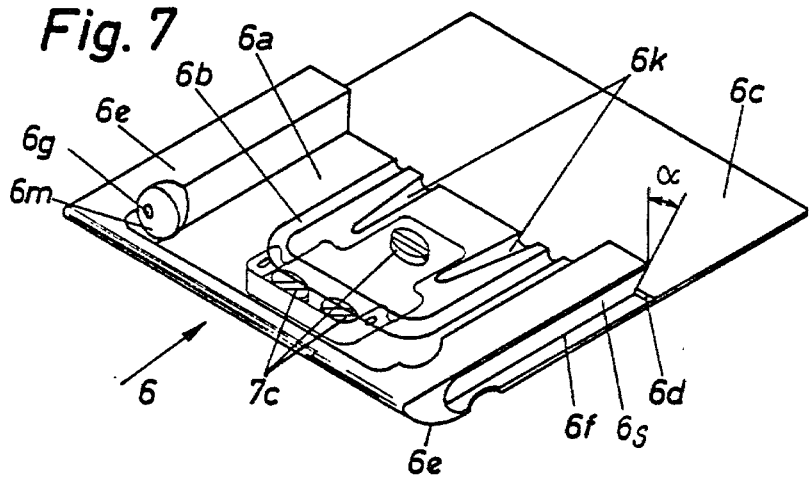
FIG. 7 is an oblique view of the underside of the pedal which is a component of the ski brake of FIG. 1.

The bight side of the support part 10*c*, which side is remote from the control legs 10*b*, and the sides or support legs 10*d* of the support part 10*c* which lie parallel with respect to the control legs 10*b* are received in a U-shaped groove 6*b* in the pedal 6 (FIG. 7). The groove 6*b* is in the bottom of a recess 6*a* on the underside of the pedal 6. The pedal 6 has a generally rectangular shape. The half of the pedal 6 closest to the tip of the ski, on which half the recess 6*a* is provided, is a member which has several recesses that are described hereinbelow. The half of the pedal 6 closest to the tail of the ski is a cover part 6*c* for tension springs 4 which will yet be described in greater detail, and ends flush with the upper side of the remaining portions of the pedal 6. The cover part 6*c* is thin in relationship to the remaining portions of the pedal 6 and constructed with a constant thickness. Where the cover part 6*c* is connected to the thicker portion of the pedal 6, a bend groove 6*d* is provided on the side facing the ski 1, which groove is positioned perpendicular to the longitudinal axis of the ski 1. The length of the bend groove 6*d* corresponds to the width of the pedal 6.

Figure 8:
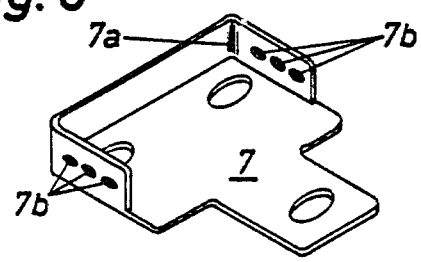
FIG. 8 is an oblique view illustrating a holding part which is a component of the ski brake of FIG. 1.

The recess 6*a* is designed sufficiently large so that, of the thicker area of the pedal 6, only a U-shaped frame 6*e* remains which opens toward the tail of the ski. The recess 6*a* receives a holding part 7 according to FIGS. 7 and 8. The holding part 7 is approximately T-shaped in a top view. The holding part 7 is arranged on the pedal 6 so that it will lie with its wider part above the bight portion of the U-shaped groove 6*b*, which groove portion extends transversely with respect to the longitudinal axis of the ski 1. The holding part 7 is secured to the pedal 6 by three holding screws 7*c* which are arranged in a triangle (FIG. 7). The edge of the holding part 7 closest to the tip of the ski and a large portion of the two adjacent edges of the same have a U-shaped holding wall 7*a* connected thereto. The holding wall 7*a* is positioned substantially vertically on the holding part 7. The sections of the holding wall 7*a* which extend parallel with respect to the longitudinal axis of the ski each have approximately in their longitudinal center at least one spring opening 7*b*. Each spring opening 7*b* is positioned so as to lie closer to the tip of the ski than the groove 6*b* of the pedal 6. The function of the openings 7*b* will be described in greater detail hereinafter.

The frame 6*e* of the pedal 6 has in each outer side surface a receiving recess 6*f* which begins adjacent the end of the pedal 6 closest to the tip of the ski, extends toward the tail of the ski and is open at the latter end. A guide surface 6*s* provided in each receiving recess 6*f* is positioned at an acute angle $\alpha$ (FIG. 7) with respect to a line perpendicular to the undersurface of the pedal. Adjacent the end of the receiving recess 6*f* closest to the tip of the ski is a pivot opening 6*g*. Each pivot opening 6*g* is positioned in the guide surface 6*s* which is inclined at the angle $\alpha$ and extends inwardly through the frame 6*e* of the pedal 6. This end of the receiving recess 6*f* is concentrically shaped around the associated bearing opening 6*g*.

Figure 3:
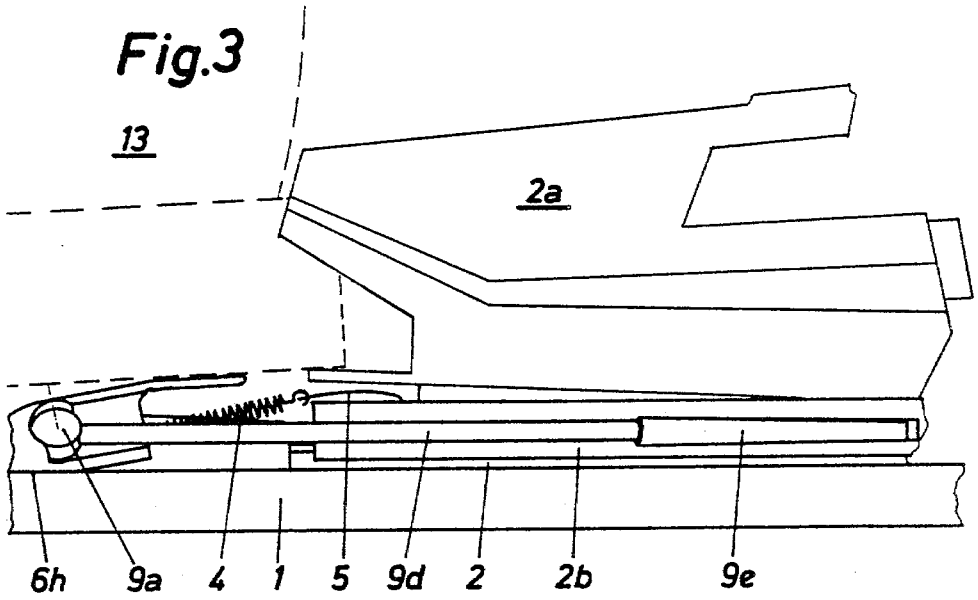
FIG. 3 is a side view of the ski brake of FIG. 1 in an intermediate retracted position.
Figure 5:
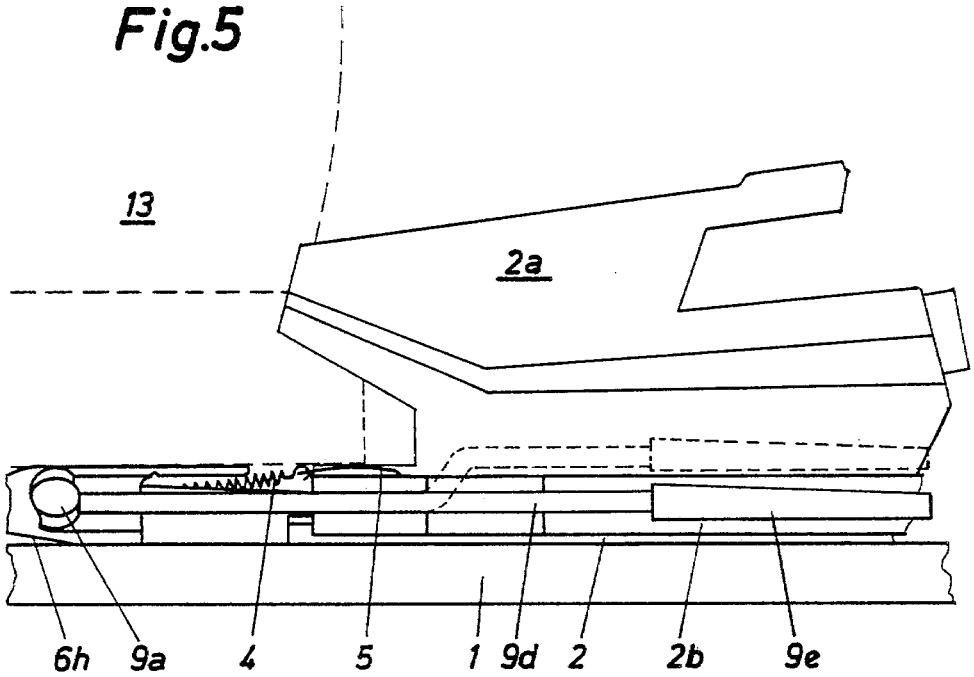
FIG. 5 is a side view of the ski brake of FIG. 1 in a fully retracted position.

The underside of the pedal 6 has, adjacent the end closest to the tip of the ski, a flattened surface 6*h* which can be recognized only in FIGS. 1, 3 and 5. The flattened surface 6*h* begins approximately below the bearing openings 6*g* and extends to the end of the pedal 6 closest to the tip of the ski 1 at an acute angle $\beta$ (FIG. 1) with respect to the rest of the undersurface of the pedal 6. The function of the flattened surface 6*h* of the pedal 6 will be described in greater detail hereinafter.

The recess 6*a* of the pedal 6 has, between the holding part 7 and each lateral leg of the groove 6*b*, a receiving point 6*k*. Each receiving point 6*k* is a groove which begins laterally of the fastening screw 7*c* which secures the narrow area of the T-shaped holding part 7, extends at a slight downward angle toward the tail of the ski, is continuously recessed and has an approximately semicircular cross-section of constant diameter. The function of the receiving points 6k will also be described in greater detail hereinafter.

The front side of the pedal 6 is flat and has in the end area which faces the tip of the ski a rounded portion 6i. The function of the rounded portion 6i will also be described in greater detail hereinafter.

The braking bars 9 are supported for limited pivotal movement in the openings 6g. For this purpose they carry at one end a disklike head 9a having on the side which faces the pedal 6 a swivel pin 9b (FIG. 4) coaxial with the axis of the disklike head 9a. The head 9a is arranged such that the swivel pin 9b lies normal to the longitudinal axis of the bar 9. The swivel pin 9b is supported pivotally in the opening 6g and projects inwardly beyond the inner end of the opening 6g into the recess 6a. A receiving depression 6m provided in the frame 6e in the area of the just described end of the opening 6g serves to receive a retaining nut 8 which is mounted on the inner end of the swivel pin 9b and maintains the braking bar 9 in the opening 6g. The bottom of the round receiving depression 6m is parallel to the guide surface 6s of the receiving recess 6f which is inclined at the angle $\alpha$, and the receiving depression 6m is disposed concentrically with respect to the opening 6g.

Each braking bar 9 carries approximately in its longitudinal center a nipple 9c. Each nipple 9c is arranged such that it lies, in the fully retracted position of the braking bar 9 (FIGS. 5 and 6), parallel with respect to the upper side 1a of the ski 1. Each nipple 9c extends slidably through a respective holding opening 3i in the base plate 3 and has a rivet at its free end to maintain it in the opening 3i. Each nipple 9c is supported for limited pivotal and axial movement in the opening 3i. The free end of each of the braking arms 9d of the braking bar 9 is provided with a plastic or similar coating 9e and functions as a braking wing.

As shown in FIGS. 1 to 4, the braking bars 9 of the preferred embodiment are substantially linear throughout their length. If desired, however, as shown by broken lines in FIGS. 5 and 6, bends may be placed in the center portion of the bars 9 so that, in the fully retracted position of the ski brake, the wings 9e of the bars 9 lie further inwardly of the sides of the ski 1. Specifically, an upward bend is preferably placed just rearwardly of the nipple 9c, followed by a rearward bend, such that the wings 9e of the braking bars 9 extend substantially parallel to the longitudinal axis of the ski.

Connected to one of the spring openings 7b on each side of the holding part 7 is one end of a tension spring 4. The other end of each tension spring 4 is connected to an opening 5a in a spring-steel gearing plate 5. The spring-steel plate 5 has a rectangular shape and the end of the spring-steel plate 5 remote from the openings 5a has a bend 5b by means of which the spring-steel plate 5 grips under or behind the connecting web 3c of the base plate 3 from the side thereof closest to the tail of the ski 1.

Figure 4:
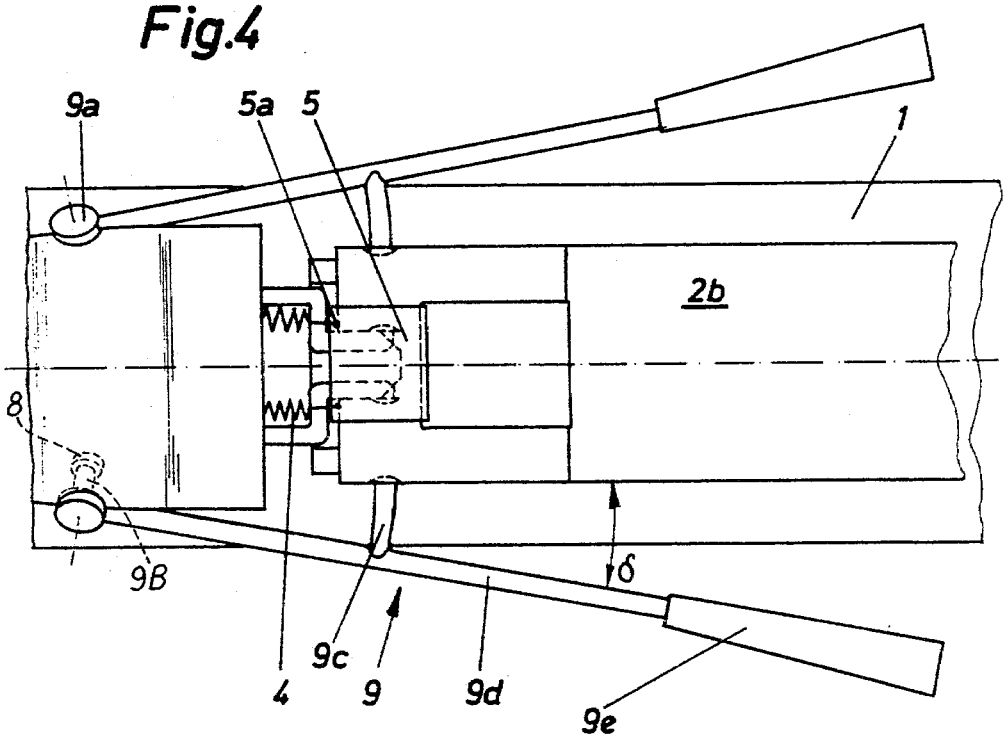
FIG. 4 is a top view of FIG. 3.

If now a substantially vertical force is applied in the direction of the arrow 11 (FIG. 1) onto the pedal 6 of the ski brake 12 when it is in the braking position, same swings counterclockwise (according to FIGS. 1 and 2) against the force of the two tension springs 4 until the flattened surface 6h is disposed against the upper side 1a of the ski 1, as shown in FIGS. 3 and 4. Each braking arm 9b of the braking bar 9 forms in this intermediate retracted position an acute angle $\delta$ (FIG. 4) with respect to the longitudinal axis of the ski 1, which angle is needed to prevent the braking bars 9 from getting caught on the lateral edges of the ski 1 during the swivelling movement of the ski brake 12.

The size of the angle $\delta$ is determined in each position of the ski brake by the slope of the guide surface 6s in the receiving recess 6f (FIG. 7), according to the following equation:

$$\delta = \text{arc tan}\,[\tan\alpha \tan\phi].$$

In the equation, $\phi$ is the angle at which the undersurface of pedal 6 extends with respect to the upper side 1a of the ski 1. Since the force in the direction of the arrow 11 is preferably applied by a ski shoe 13, shown in FIGS. 3 and 5 by broken lines, onto the pedal 6, a possible catching of the pedal on the sole of the ski shoe 13 is prevented by the rounded portion 6i of the pedal 6.

Due to the fact that the cover part 6c is connected with a bend groove 6d to the remaining part of the pedal 6 and is thus flexible with respect thereto, the cover part 6c rests in the just described intermediate retracted position of the ski brake 12 flat on the sole of the ski shoe 13 as shown in FIG. 3.

Figure 6:
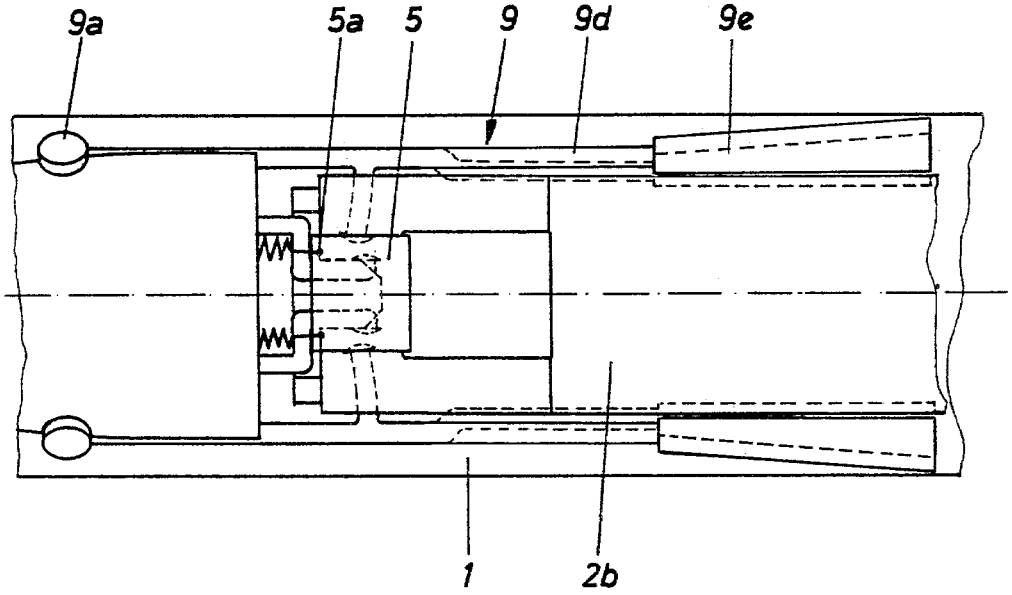
FIG. 6 is the top view of FIG. 5.

During further stepping down on the pedal 6, same swivels on the bight of the support part 10c of the bearing bar 10 in in clockwise direction and the braking bars 9 pivot counterclockwise until the ski brake is in the fully retracted position shown in FIGS. 5 and 6. During this swivelling movement, the guide surfaces 6s in the two receiving recesses 6f pivot relative to the disklike heads 9a about the swivel pins 9b of the braking bars 9, thereby causing the braking arms 9d of the bar 9 to swing in over the side surfaces of the ski 1 to a position parallel to the longitudinal axis of the ski 1 (FIGS. 5 and 6). In this position of the ski brake 12, nipples 9c have moved axially inwardly in the holding openings 3i and the spring-steel plate 5 lies approximately parallel with respect to the upper side 1a of the ski 1. The two tension springs 4, which now have their greatest tension, each lie in a respective one of the two receiving points 6k in the pedal 6. The flattened surface 6h projects in this position of the pedal 6 away from the upper side 1a of the ski 1 at the angle $\beta$.

If the ski shoe 13 is now removed and no force acts in the direction of the arrow 11 onto the pedal 6, then the pedal 6 is first swung by the two tension springs 4 into the intermediate retracted position illustrated in FIGS. 3 and 4. The torque which is needed for this swivelling is created by the fact that the openings 7b, into which one end of the tension springs 4 is hooked, are arranged vertically below the support axis of the pedal 6 on the bearing bar 10.

In the just described counterclockwise swivelling movement of the pedal 6, the braking arms 9d of the braking bar 9 are swung with the respectively associated coatings 9e laterally outwardly by the movement of the pedal 6 to a position (FIG. 4) beyond the side surfaces of the ski 1 at which the riveted ends of the nipples 9c contact the base plate 3 and limit further such movement.

Further contraction of the tension springs 4 swings the pedal 6 and ski brake 12 in a clockwise direction into the braking position of FIGS. 1 and 2 with the free ends of the braking arms 9d extending below the running surface of the ski 1. The upward swing of the ski brake 12 is limited when the two control legs 10*b* of the bearing bar 10 hit the overload edges 3*f* of the base plate 3. When the two bearing legs 10*b* thus run into the overload edges 3*f*, a breaking of the structural parts of the ski brake 12 is avoided because the parts 10*b* of the bearing bar 10, which is manufactured of spring-steel wire, are compressed laterally inwardly toward each other as they slide along the edges 3*f* and the bearing ends 10*a* slide axially in the openings 3*h*. Since the bearing bar 10 always has a tendency to resume its relaxed position, it then presses laterally outwardly with the control legs 10*b* onto the overload edges 3*f* and, following dissipation of the overload, they again slide laterally outwardly along the edges 3*f* into the position illustrated in FIGS. 1 and 2, thus returning the braking bar 9 to the braking position illustrated in FIGS. 1 and 2.

More specifically, as the tension springs 4 pivot the braking bars 9 around the axes defined by the nipples 9 into the braking position, the bearing bar 10 pivots around the axes defined by the bearing pins 10*a* and the control legs 10*b* slide inwardly along the lateral edges of the recess 3*e*. When the control legs 10*b* reach the overload edges 3*f* in the recess 3*e*, they slide along the overload edges 3*f*, causing the control legs 10*b* to move toward each other and the bearing pins 10*a* to slide axially inwardly in the bearing openings 3*h*, thereby flexing the bearing bar 10 slightly out of its normal shape. In essence, the pivotal momentum of the bearing bar 10 and braking bars 9 is translated by the cooperation of the control legs 10*b* and the overload surfaces 3*f* into forces directed inwardly substantially in the direction of the axes of the bearing pins 10*a*, which forces are then absorbed by the compression of the bearing bar 10. This also momentarily causes the braking bars 9 to assume a slightly steeper angle with respect to the ski 1 than in the normal braking position illustrated in FIGS. 1 and 2. Once the forces are dissipated, the tendency of the bearing bar 10 to resume its normal shape causes the control legs 10*b* to slide outwardly along the overload edges 3*f* until they reach the lateral edges of the recess 3*e* and to remain in this position, which position is illustrated in FIGS. 1 and 2.

FIGS. 12 to 15 illustrate certain details of an embodiment of a ski brake which differs slightly from the embodiment described above. Specifically, the braking bars 9' have bends 9*k'* and are connected to the disklike heads 9*a* in the center of the side opposite the swivel pins 9*b*. If desired, each braking bar 9 can extend through the associated head 9*a*, coaxial therewith, to form the swivel pins 9*b*. In other respects, the structure and operation of the embodiment of FIGS. 12 to 15 is identical to that described above with respect to the embodiment of FIGS. 1 to 11.

Further embodiments are conceivable without leaving the scope of the invention. Thus, for example, it would be within the scope of the invention to construct the part of the base plate which is under the spring-steel plate lower so that the spring-steel plate would not project above the level of the base plate in the fully retracted position of the ski brake. Also it would be possible to bend the part of the base plate on which the spring-steel plate is suspended slightly downwardly toward the ski, through which a better suspension of the spring-steel plate and thus of the entire braking mechanism would result. A still further possibility would be to fully cover the support of the braking bar on the pedal to almost totally eliminate damaging environmental influences. Furthermore, one could leave out the bearing bar and use just the braking bars for supporting the pedal. Same would have a design which corresponds with the stability and the function and thus, for example, the two nipples would also extend through the bearing openings of the bearing plates of the base plate.

For the simple manufacture of the base plate one could manufacture the areas of the same which are used for guiding from plastic. The base plate would then consist of two or more parts.

The above-listed examples represent only a small portion of the possibilities for various constructions which are available to the man skilled in the art, and all lie within the scope of the invention.

The embodiments of the invention in which an exclusive property or privilege is claimed are defined as follows:

1. In a ski brake having a base plate, a pedal and two braking mandrels which project, in a braking position, next to the two ski edges below the running surface of the ski and which are each the free end of a respective, pivotally supported braking arm, first swivel axes of said braking arms each extending transversely with respect to the ski and being inclined in relationship thereto, said braking arms being movably supported on guide surfaces which extend normal to the respective first swivel axes and being pivotal about second swivel axes against the urging of an erecting spring from the braking position into a fully retracted position in which the two braking arms are held approximately parallel with respect to the upper side of the ski and at least partially above the same, the improvement comprising wherein each said braking arm has a head; wherein said guide surface for each individual braking arm is defined by a receiving recess constructed in a frame of said pedal and in the fully retracted position forms an acute angle with respect to the upper side of the ski, in which receiving recesses said heads of said individual braking arms are supported on said guide surfaces, said braking arms each being pivotal about a said first axis which is normal to said guide surface in the associated receiving recess of said pedal; wherein each of said braking arms has a nipple which is supported in a respective holding opening provided in said base plate and, in relationship to the longitudinal axis of the ski, is movable transversely back and forth; wherein in alignment with said two holding openings in said base plate there are provided bearing openings in bearing plates of said base plate, each said bearing opening receiving a respective bearing pin of an approximately omega-shaped bearing bar, said bearing bar including a support part at a location remote from said two bearing pins, said support part including support legs and portions of said support legs, at least in the fully retracted position, being received in a groove in said pedal, and said pedal being movably supported on a portion of said support part; and wherein said pedal has on an end thereof which is remote from said second swivel axes a flattened surface which extends at an acute angle with respect to the plane of the undersurface of said pedal.

2. The ski brake according to claim 1, wherein said pedal has a bend groove which extends substantially at a right angle with respect to the longitudinal axis of the ski; wherein the portion of said pedal which receives said bearing bar is constructed as a member with several recesses and the remaining portion of said pedal is constructed as a thin cover part; wherein in said member of said pedal there are provided said receiving recesses for receiving said braking arms in their swung-in position and at least one receiving point for receiving said erecting spring in the fully retracted position; and wherein one end of said erecting spring is connected to said pedal.

3. The ski brake according to claim 2, wherein the other end of said erecting spring is connected to a spring-steel plate, which spring-steel plate in turn is secured on said base plate.

4. The ski brake according to claim 1 or claim 2, wherein said base plate has in the region thereof which receives said bearing bar a recess which extends in the direction of the longitudinal axis of the ski, an end area of said base plate recess having on each side an overload edge, which overload edges each define an angle of approximately 45° with respect to the longitudinal axis of the ski.

5. The ski brake according to one of the claims 1 or 2, wherein said bearing bar has two bearing legs which slidably engage opposite sides of said base plate recess and has a certain elasticity at a right angle with respect to the longitudinal axis of the ski, so that when an overload acts onto the ski brake, said two bearing legs of said bearing bar slide along said two overload edges of said base plate and said bearing bar assumes a braking position which differs from the usual braking position in that it forms a steeper angle in relationship to the upper side of the ski.

6. The ski brake according to claim 1 or 2, wherein said pedal is pivotally supported on said bearing bar for movement about a third swivel axis; wherein on the underside of said pedal there is secured an approximately T-shaped holding part which has at least one spring opening which is aligned at a right angle with respect to the longitudinal axis of the ski and in which one end of said erecting spring is connected; wherein said holding part has along its forward edge and along its two adjacent edges a holding wall in which said spring opening is provided; and wherein said spring opening is arranged vertically lower than said third swivel axis of said pedal on said bearing bar.

7. The ski brake according to claim 6, wherein in said holding wall of said holding part there are provided several said spring openings which are arranged one after another in the direction of the longitudinal axis of the ski, which spring openings permit a change of the initial tension of said erecting spring for different braking actions, or an adjusting of the spring tension in the case of a change of the spring tension, within certain limits.

8. The ski brake according to claim 1, wherein said head of each said braking arm is constructed with a swivel pin, which swivel pin is supported in a pivot opening provided in said pedal in communication with a respective said receiving recess, extends through said pivot opening and is secured against axial movement therein by retaining means provided on its free end.

9. The ski brake according to claim 1, wherein said two nipples of said braking bars also extend through said bearing openings in said base plate and are supported for movement back and forth in said bearing openings at approximately a right angle with respect to the longitudinal axis of the ski.

10. The ski brake according to claim 1, wherein said braking arms are each bent twice, wherein a first said bend, in the fully retracted position, turns upwardly and a second said bend turns rearwardly so that a braking wing which is provided on the end of said braking arm extends approximately parallel with respect to the longitudinal axis of the ski.

11. The ski brake according to claim 1, wherein each said braking arm forms with respect to the longitudinal axis of the ski an acute angle $\delta$, the size of which is determined by the equation $$\delta = \arctan(\tan\alpha \tan\phi),$$

wherein $\alpha$ is the angle at which said guide surface in each receiving recess extends with respect to a line perpendicular to the plane of the undersurface of said pedal, and $\phi$ is the angle at which the undersurface of said pedal extends with respect to the upper side of the ski, said pedal being pivotally supported on said braking bar.

12. In a ski brake having at least two braking mandrels which project, in a braking position, next to the two ski edges below the running surface of the ski, which braking mandrels are the free ends of respective, pivotally supported braking arms, first swivel axes of said braking arms each extending transversely with respect to the upper side of the ski and being inclined with respect to the upper side of the ski, said braking arms being movably supported on guide surfaces which extend normal to the respective first swivel axes and define, together with an operating pedal, a braking mechanism which, in relationship to a ski-fixed base plate, can be swung about a second swivel axis against the urging of an erecting spring from the braking position into a fully retracted position, in which latter position the two braking arms are held approximately parallel with respect to the upper side of the ski and at least partially above the same, the improvement comprising wherein each said braking arm has a head; wherein said guide surfaces for said respective braking arms are constructed as sloped surfaces partially defining receiving recesses in said pedal and which, in the fully retracted position of the ski brake, extend at an acute angle with respect to the upper side of the ski; wherein the receiving recesses are arranged in a frame of the pedal and symmetrically with respect to the longitudinal axis of the same, in which receiving recesses said heads of said individual braking arms are supported against respective said guide surfaces, said braking arms each being pivotal about a respective said first swivel axis which is positioned normal to said associated guide surface; wherein each of said braking arms has a nipple which is supported in a respective holding opening provided in said base plate and is reciprocally movable in the holding opening transversely of the longitudinal axis of the ski; wherein in the base plate in alignment with said two holding openings there are provided bearing openings, each said bearing opening receiving a respective bearing pin of an approximately omega-shaped bearing bar, which bearing pins form said second swivel axis of said braking mechanism; wherein the portion of said bearing bar which is remote from said two bearing pins includes a support section having support legs, portions of said support legs, at least in the fully retracted position of the braking mechanism, being received in a receiving groove of said pedal, and said pedal being movably supported on a portion of said support part; and wherein the underside of said pedal has on its end which is remote from said second swivel axis a flattened surface which extends at an acute angle with respect to the remainder of the underside of said pedal.

13. The ski brake according to claim 12, wherein said pedal has a bend groove which extends substantially at a right angle with respect to the longitudinal axis of the ski, wherein one portion of said pedal is constructed as a thin cover part which substantially covers said bearing bar, wherein the portion of said pedal which receives said support part of said bearing bar has recesses for said heads of said braking arms and has at least one receiving point for receiving said erecting spring in the fully retracted position of said braking mechanism, and wherein one end of said erecting spring is connected to said pedal.

14. The ski brake according to claim 13, wherein the other end of said erecting spring is connected to one end of a spring-steel plate, the other end of which plate is secured on said base plate.

15. The ski brake according to claim 12, wherein said bearing bar has two control legs which are connected to said bearing pins, and wherein said base plate has a recess which receives said control legs of said bearing bar and extends in the direction of the longitudinal axis of the ski, each side of said base plate recess at an end thereof having an overload surface which defines an angle of approximately 45° with respect to the longitudinal axis of the ski.

16. The ski brake according to claim 12 or 13, wherein on the underside of said pedal there is secured an approximately T-shaped holding part which has at least one spring opening which is aligned at a right angle with respect to the longitudinal axis of the ski, in which spring opening is connected one end of said erecting spring, and wherein said holding part has at its forward edge and its two adjacent edges a holding wall in which said spring opening is provided, said spring opening being arranged approximately below the support of said bearing bar on said pedal, and wherein in said holding wall of said holding part there are provided several said spring openings which are arranged one after another in the direction of the longitudinal axis of the ski.

17. The ski brake according to claim 12, wherein said nipples on said braking arms extend through said bearing openings in said base plate and are supported for movement in said bearing openings at approximately a right angle with respect to the longitudinal axis of the ski.

18. The ski brake according to claim 12, wherein each said braking arm forms with respect to the longitudinal axis of the ski an acute angle $\delta$, the size of which is determined by the equation $$\delta = \arctan(\tan\alpha \tan\phi),$$

wherein $\alpha$ is the angle at which each said guide surface extends with respect to a line perpendicular to the plane of the undersurface of said pedal and $\phi$ is the angle at which the undersurface of said pedal extends with respect to the upper side of the ski, said pedal being pivotally supported on said bearing bar.

* * * * *

UNITED STATES PATENT AND TRADEMARK OFFICE

CERTIFICATE OF CORRECTION

PATENT NO. : 4 359 235

DATED : November 16, 1982

INVENTOR(S) : Heinz Wittmann

It is certified that error appears in the above—identified patent and that said Letters Patent is hereby corrected as shown below:

Col. 12, line 15; change "braking" to ---bearing---.

Col. 12, line 58; change "the" to ---a---.

Col. 12, line 60; change "section" to ---part---.

Col. 13, line 7; after "has" insert ---said---.

Signed and Sealed this

*Fourteenth* Day of *June 1983*

[SEAL]

*Attest:*

DONALD J. QUIGG

*Attesting Officer*

*Acting Commissioner of Patents and Trademarks*